United States Patent [19]

Nakayama et al.

[11] 4,408,962

[45] Oct. 11, 1983

[54] SWASH PLATE TYPE COMPRESSOR

[75] Inventors: Shozo Nakayama, Kariya; Shigeru Suzuki, Nishio; Mitsuhiro Hattori, Kariya, all of Japan

[73] Assignee: Kabushiki Kaisha Toyoda Jidoshokki Seisakusho, Aichi, Japan

[21] Appl. No.: 139,241

[22] Filed: Apr. 11, 1980

[30] Foreign Application Priority Data

Sep. 14, 1979 [JP] Japan ..... 54-118129

[51] Int. Cl.[3] ..... F04B 1/16

[52] U.S. Cl. ..... 417/269

[58] Field of Search ..... 417/269

[56] References Cited

U.S. PATENT DOCUMENTS

| | | | |
|---|---|---|---|
| 3,801,227 | 4/1974 | Nakayama | 417/269 |
| 4,003,680 | 1/1977 | Nakayama | 417/269 |
| 4,070,136 | 1/1978 | Nakayama | 417/269 |
| 4,135,862 | 1/1979 | Degawa | 417/269 |
| 4,326,838 | 4/1982 | Kawashima | 417/269 |

FOREIGN PATENT DOCUMENTS

| | | | |
|---|---|---|---|
| 55-19916 | 2/1980 | Japan | 417/269 |

*Primary Examiner*—William L. Freeh

*Attorney, Agent, or Firm*—Cushman, Darby & Cushman

[57] ABSTRACT

A swash plate type compressor comprising a plurality of cylinder bores and pistons, a swash plate chamber wherein a swash plate for reciprocating the pistons within the cylinder bores is fixed to and rotated with a drive shaft, at least one suction passage communicated with the swash plate chamber, suction chambers and exhaust chambers communicated with the cylinder bores, respectively.

Two inlet ports open into the swash plate chamber so as to be opposed to a peripheral side surface of the swash plate when it is inclined to its utmost limit into a front side and a rear side in a predetermined longitudinal section of the compressor.

The fluid sucked into the compressor is compressed therein with uniform volumetric efficiency without obstructed by the rotation of the swash plate.

1 Claim, 6 Drawing Figures

SWASH PLATE TYPE COMPRESSOR

BACKGROUND OF THE PRESENT INVENTION

The present invention relates to a swash plate type compressor, particularly to an intake system thereof.

In general, a swash plate type compressor has a construction wherein a swash plate is fixed to a drive shaft which penetrates the axial portion of a cylinder block, so as to be inclined with the drive shaft, and pistons are slidably inserted within cylinder bores and engaged with the swash plate through bearing means.

Due to the rotation of the drive shaft, the swash plate is rotated therewith and the pistons reciprocate within the cylinder bores.

FIG. 1 is a longitudinal sectional view of the conventional swash plate type compressor having the above described construction. In FIG. 1, a front cylinder block 1 and a rear cylinder block 2 are joined so as to be opposed to each other. Both ends of the joined cylinder blocks 1 and 2 are covered by a front housing 5 and a rear housing 6 airtightly through a valve plates 3 and 4, respectively.

A drive shaft 7 extends penetrating the axial portion of the cylinder blocks 1 and 2. And a swash plate 9 is integrally fixed to the drive shaft 7 within a swash plate chamber 8 which is provided near the joining portion of the cylinder blocks 1 and 2.

Pistons 12 are engaged with the swash plate 9 through a bearing means composed of balls 10 and shoes 11. Due to the rotation of the drive shaft 7, the swash plate 9 is rotated therewith and the pistons 12 reciprocate within the cylinder bores 13 and 14 formed in the cylinder blocks 1 and 2.

As a result, the fluid flowed from suction chambers 15 formed in the front and rear housings 5 and 6 into the cylinder bores 13 and 14 is compressed and then the compressed fluid is flowed into exhaust chambers 16 formed in the front and rear housings 5 and 6. Then, the compressed fluid is supplied to an outer pipeline.

Suction passages 17F and 17R are formed between the adjacent cylinder bores. The swash plate chamber 8 is communicated with the suction chambers 15 through the suction passages 17F and 17R.

And an inlet port 18 is perforated in the outer wall of the cylinder block 2 so as to open into the nearly middle portion of the swash plate chamber 8 in a longitudinal direction thereof. The swash plate chamber 8 is communicated with an outer pipeline through the inlet port 18 and an inlet flange 19.

The fluid is sucked from the outer pipeline into the swash plate chamber 8 through the inlet flange 19 and the inlet port 18 and is introduced into the suction chambers 15 through the suction passages 17F and 17R.

In the conventional compressor having the above described construction, the inlet port 18 opens into the axially middle portion of the swash plate chamber 8, namely in the axially middle portion of the travelling range of the swash plate 9.

As shown in FIG. 1, when the swash plate 9 is inclined to the utmost limit thereof in a predetermined longitudinal section including the inlet port 18 so that one surface of the swash plate 9 facing the front housing 5 is opposed to the opening of the inlet port 18, the fluid which is introduced through the inlet port 18 toward the suction passage 17R is firstly flowed down along the surface of the swash plate 9 to the nearly central portion of the swash plate chamber 8 due to inertia thereof.

Then, the fluid is flowed into the suction passage 17R over the peripheral side surface of the swash plate 9 as shown by an arrow B. As a result, the inlet resistance of the fluid flowed into the cylinder bore 14 becomes relatively larger.

In contrast, the fluid which is introduced through the inlet port 18 toward the suction passage 17F is flowed directly into the suction passage 17F as shown by an arrow A without obstructed by the swash plate 9.

Next, when the swash plate 9 is inclined into the front side of the compressor to the utmost limit in the longitudinal section as shown in FIG. 1, so that the other surface of the swash plate 9 in the rear side is opposed to the opening of the inlet port 18, the inlet resistance of the fluid flowed into the cylinder bore 13 becomes relatively larger.

As a result, it becomes difficult to make the volume of the fluid flowed into the cylinder bores of the front side and the rear side uniform constantly.

Consequently, volumetric efficiency is lowered. And the pulsation of the inlet pressure and the outlet pressure becomes larger so that the vibrations and the noize generating in the conventional compressor during its operation, become larger.

Accordingly, one object of the present invention is to provide an improved swash plate type compressor, of which volumetric efficiency is maintained good.

Another object of the present invention is to provide an improved swash plate type compressor, of which inlet resistance is scarcely obstructed by the rotation of the swash plate.

Still another object of the present invention is to provide an improved swash plate type compressor which compresses the fluid without generating vibrations or noize.

DESCRIPTION OF THE DRAWINGS

Other objects and advantages of the invention will become apparent from the following description of embodiments with reference to the accompanying drawings wherein.

DETAILED DESCRIPTION

Hereinafter, the present invention will be explained in accordance with the present invention with reference to the accompanied drawings.

Figure 2:
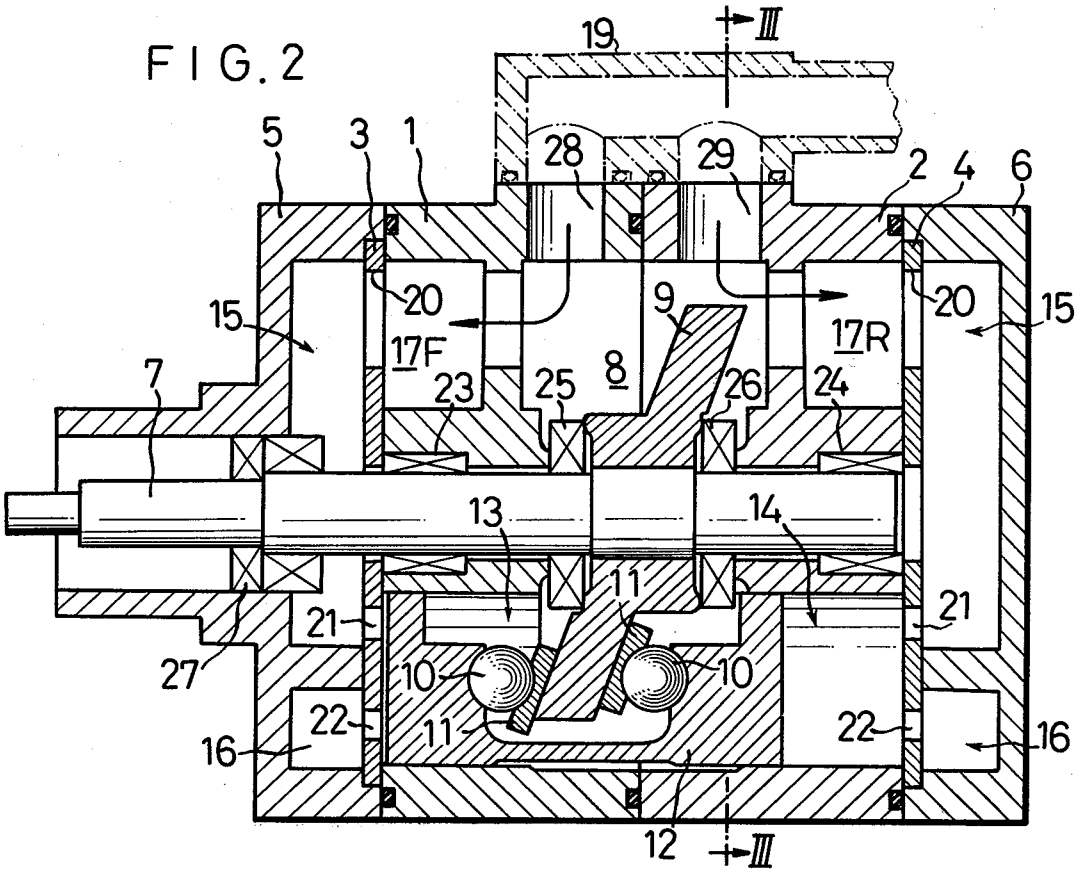
FIG. 2 is a longitudinal sectional view of a swash plate type compressor of the present invention taken along the line II—II of FIG. 3.

In FIG. 2, cylinder blocks 1 and 2 are provided with a plurality of cylinder bores 13 and 14 which are opposed with each other, respectively. And the cylinder blocks 1 and 2 are joined with each other in a substantially central portion of a compressor to form a combined block.

In the neighbourhood of the contact portion between the cylinder blocks 1 and 2, a swash plate chamber 8 is formed.

Figure 3:
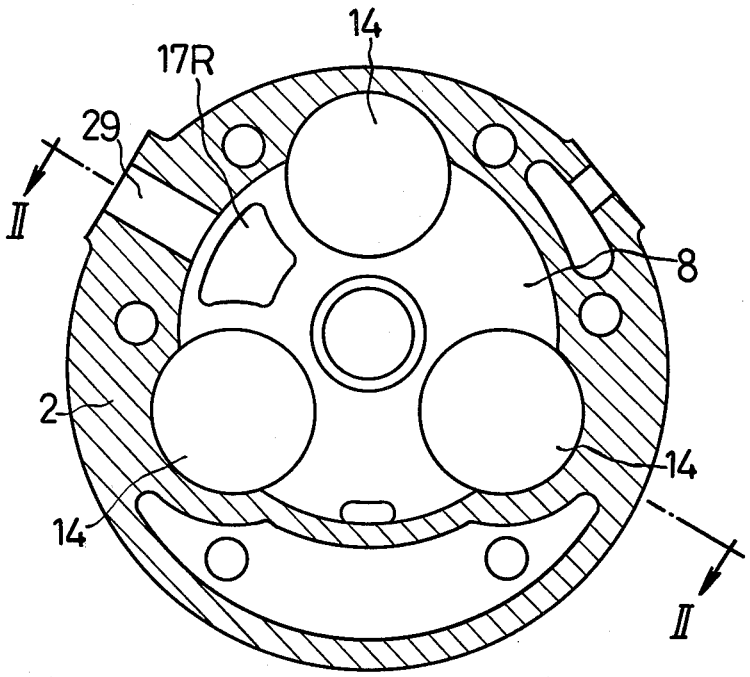
FIG. 3 is a cross sectional view of a cylinder block of the compressor taken along the line III—III of FIG. 2.

And as shown in FIG. 3, the suction passage 17R (17F) is provided between the adjacent cylinder bores 14 (13).

Both end portions of the combined block are airtightly covered with a front housing 5 and a rear housing 6 through valve plates 3 and 4, respectively.

A drive shaft 7 is inserted in the combined block, penetrating an axial portion thereof from the side of the front housing 5. And the drive shaft 7 is rotatably supported by bearings 23 and 24.

A swash plate 9 is fixed to the drive shaft 7 within the swash plate chamber 8. And thrust bearings 25 and 26 support the swash plate 9.

Pistons 12 are inserted within the cylinder bores 13 and 14 and are engaged with the swash plate 9 through a bearing device which is composed of balls 10 and shoes 11, respectively.

Within the front housing 5 and the rear housing 6, suction chambers 15 and exhaust chambers 16 are formed, respectively. The suction chambers 15 are communicated with the suction passages 17F and 17R through ports 20 perforated in the valve plates 3 and 4, respectively. And the suction chambers 15 are communicated with the cylinder bores 13 and 14 through suction ports 21 which are perforated in the valve plates 3 and 4, respectively. The exhaust chambers 16 are communicated with the cylinder bores 13 and 14 through exhaust ports 22 which are perforated in the valve plates 3 and 4, respectively. And the exhaust chambers 16 are communicated with an outer pipeline of the exhaust side of the compressor.

In both of the suction ports 21 and the exhaust ports 22, suction reed valves (not shown) and exhaust reed valves (not shown) are provided, respectively.

Within the front housing 5, a shaft seal member 27 is provided around the drive shaft 7, which seals the drive shaft 7 relative to the front housing 5.

In the outer wall of the combined cylinder block which defines the swash plate chamber 8, inlet ports 28 and 29 are perforated in alignment with each other in a longitudinal direction of the combined cylinder block. The inlet ports 28 and 29 are communicated with an outer pipeline through an inlet flange 19.

Each of the inlet ports 28 and 29 opens into the swash plate chamber 8 so as to be opposed to a peripheral side surface of the swash plate 9 when it is inclined to its utmost limit in a front side and a rear side of the combined block in a predetermined longitudinal section thereof including the drive shaft.

And it is preferable that each of the wall surfaces which define the two inlet ports 28 and 29 in the side of the center of the swash plate chamber 8 in the above longitudinal section is nearly in alignment with an edge portion of the swash plate when it is inclined to its utmost limit in a front side and a rear side of the combined block in a predetermined longitudinal section thereof including the drive shaft.

And it is more preferably that each of the wall surfaces which define the two inlet ports 28 and 29 in the side of the ends of the swash plate chamber 8 in a predetermined longitudinal section is deviated from the other edge portion of the swash plate 9 by a predetermined distance when the swash plate 9 is inclined to the utmost limit thereof in a front side or a rear side of the combined block in the above described longitudinal section.

Hereinafter, the operation of the present invention having the above described construction will be explained.

When the drive shaft 7 is rotated due to a driving force applied from an outer driving source, the swash plate 9 which is fixed to the drive shaft 7 is rotated and the pistons 12 reciprocate within the cylinder bores 13 and 14. Then, the fluid is sucked from the outer pipeline into the swash plate chamber 8 through the inlet flange 19 and the inlet ports 28 and 29. And the fluid is introduced into the suction chambers 15 through the suction passages 17F and 17R. And the fluid is introduced into the cylinder bores 13 and 14, through the suction ports 21.

Then, the fluid is compressed within the cylinder bores 13 and 14 due to the reciprocation of the pistons 12 and discharged into the exhaust chambers 16 through the exhaust ports 22. Then, the compressed fluid is supplied into the outer pipeline through the outlet port (not shown).

The fluid which is sucked through the inlet port 28 opening in the front cylinder block 1 is introduced into the suction passage 17F of the front side. And the fluid which is flowed through the inlet port 29 opening in the rear cylinder block 2 is introduced into the suction passage 17R of the rear side. When the swash plate 9 is inclined as shown in FIG. 2, the fluid which is flowed from the inlet port 28, is flowed into the suction passage 17F, changing its course within the swash plate chamber 8 without obstructed by the swash plate 9.

And the fluid which is sucked through the inlet port 29 is changed its course forcibly, colliding against the peripheral side surface of the swash plate 9 which is opposed to the opening of the inlet port 29. Then, the fluid is introduced into the suction passage 17R at once without flowing toward the center of the swash plate chamber 8 guided by the swash plate 9.

When the swash plate 9 is inclined so that the peripheral side surface thereof is opposed to the opening of the inlet port 28, the fluid sucked through the inlet ports 28 and 29 is flowed into the suction passages 17F and 17R through the swash plate chamber 8, respectively without obstructed by the swash plate 9, following the similar process to the above described process.

And also, when the peripheral side surface of the swash plate 9 is positioned so as to be opposed to the middle of the inlet ports 28 and 29 in a longitudinal direction of the combined cylinder block, the fluid is introduced into the suction passages 17F and 17R at once without obstructed by the swash plate 9.

As described above, even if the swash plate 9 is rotated within the swash plate chamber 8, the fluid flowed into the swash plate chamber 8 is sucked into the suction passages 17F and 17R at once without obstructed thereby. Therefore, the volume of the fluid sucked into the suction passages 17F and 17R is always maintained uniform.

In this case, if each of the wall surfaces which define the two inlet ports 28 and 29 in the side of the center of the swash plate chamber 8 in a predetermined longitudinal section is nearly in alignment with an edge portion of the swash plate 9 when it is inclined to its utmost limit in a front side or rear side of the combined block in the longitudinal section thereof as shown in FIG. 2, the fluid sucked through the inlet ports 28 and 29 is scarcely flowed down along the surface of the swash plate 9, toward the center of the swash plate chamber 8. Almost all the fluid sucked through the inlet ports 28 and 29 is introduced into the suction passages 17F and 17R without obstructed by the rotating swash plate 9.

And if each of the wall surfaces which define the two inlet ports 28 and 29 in the side of the ends of the swash plate chamber 8 in a predetermined longitudinal section is deviated from the other edge portion of the swash plate 9 by a predetermined distance when the swash plate 9 is inclined to its utmost limit in a front side or a rear side of the combined block in the longitudinal section thereof shown in FIG. 2, one part of the fluid which is flowed from the inlet port 28 or 29 is directly flowed into the front side or the rear side of the swash plate chamber without colliding against the peripheral side surface of the swash plate 9. Therefore, the inlet resistance of the sucked fluid can be remarkably lowered into a low level.

However, the above described wall surface of each of the inlet ports 28 and 29 is deviated too much from the other edge portion of the swash plate 9, the inlet flange 19 becomes too large to maintain the cost of the compressor low.

As described above, according to the present invention, in the combined cylinder block, two inlet ports are perforated to open into the swash plate chamber so that each of the openings thereof is opposed to the peripheral side surface of the swash plate when it is inclined to its utmost limit into the front side or the rear side of the combined block in a predetermined longitudinal section thereof.

As a result, the flowing efficiency of the fluid into the front side and the rear side becomes uniform with each other to increase the volumetric efficiency thereof. And the pulsation of the inlet pressure is prevented and the noize and vibrations of the compressor occurring due to the pulsation of the outlet pressure can be reduced.

EXPERIMENT 1

Figure 1:
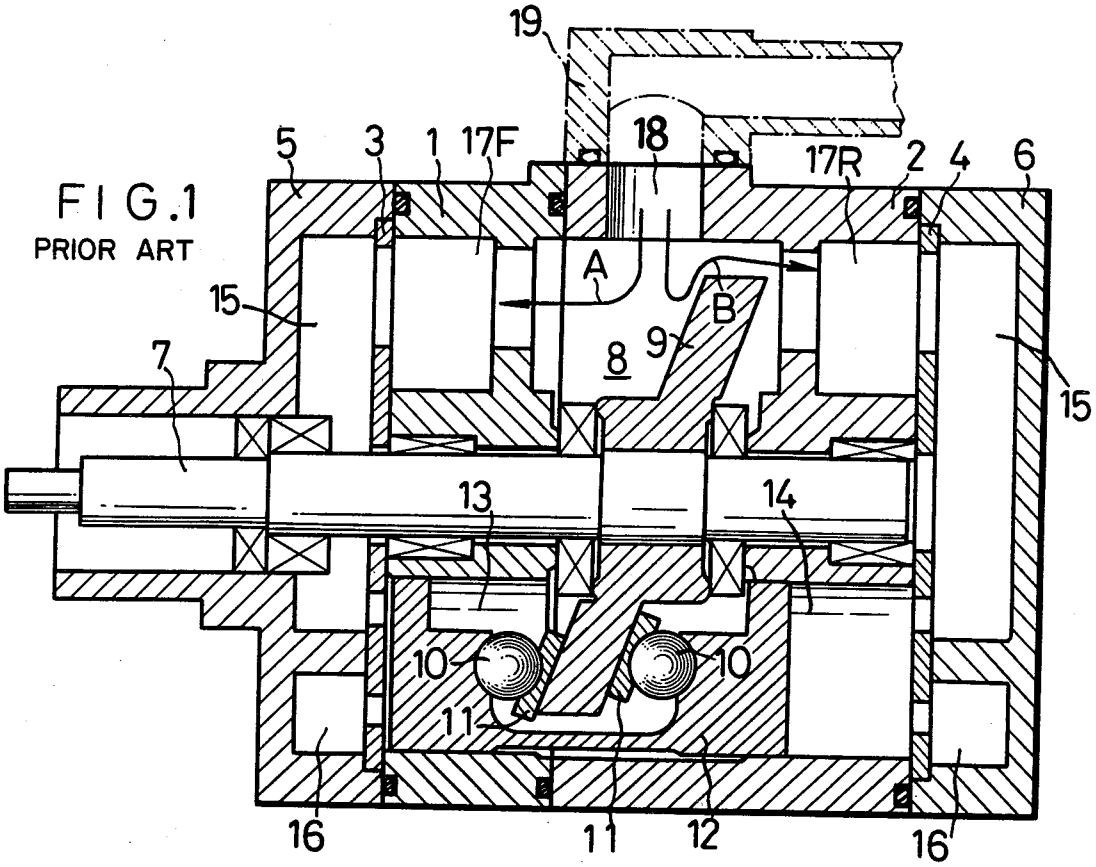
FIG.1 PRIOR ART
FIG. 1 is a longitudinal sectional view of a conventional swash plate type compressor.

The conventional compressor as shown in FIG. 1 and the compressor of the present invention as shown in FIGS. 2 and 3 were operated under the following conditions. And the change of the inlet pressure and that of the outlet pressure in the inlet flange and the outlet flange of each of the compressors were observed by means of an oscilloscope.

Conditions (1) Compressor:
  (1) Six-cylinder swash plate type refrigerant compressor
  (2) Volume of the compressor: 134 cc/rev.
(2) Operating Conditions:
  (1) Inlet pressure: 2 kg/cm$^2$G
  (2) Outlet pressure: 15 kg/cm$^2$G
  (3) Engine speed: 3000 rpm

Experimental Result

Figure 4:
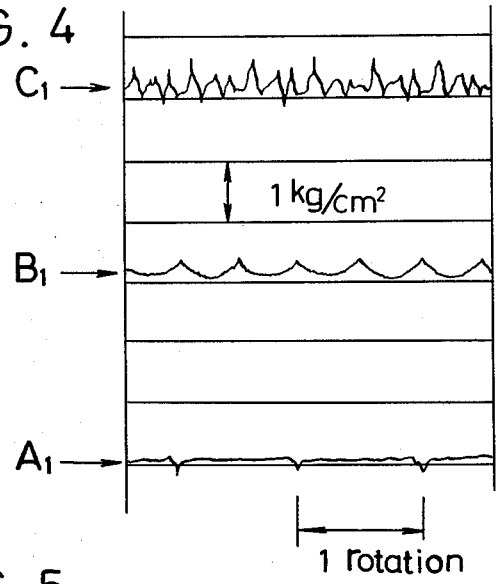
FIGS. 4 and 5 are graphs showing the changes of the inlet pressure and the outlet pressure during the operation of the conventional compressor and the compressor of the present invention, respectively.
Figure 5:
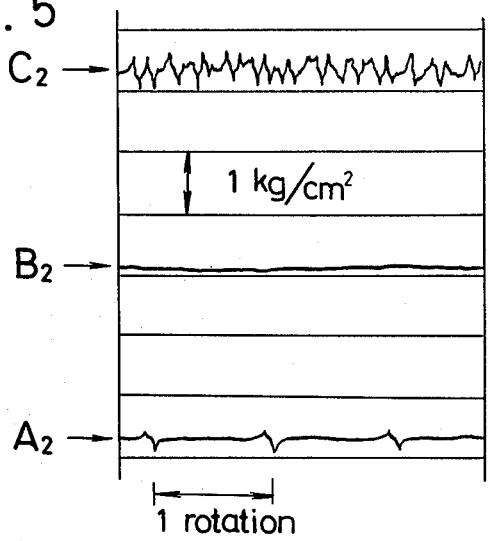

FIG. 4 shows the experimental result of the conventional compressor and FIG. 5 shows that of the compressor of the present invention. In FIGS. 4 and 5, $A_1$ and $A_2$ are signals showing the rotation of the compressors, $B_1$ and $B_2$ show the change of the inlet pressure, respectively, and $C_1$ and $C_2$ show the change of the outlet pressure, respectively.

As is apparent from the drawings, according to the conventional compressor, the inlet pressure thereof pulsates two times per one rotation thereof within the range of 0.2–0.3 kg/cm$^2$G.

In contrast, according to the compressor of the present invention, the pulsations of the inlet pressure are scarcely observed.

And the outlet pressure pulsates within the range of 0.6–0.7 kg/cm$^2$G in the conventional compressor.

In contrast, in the compressor of the present invention, the outlet pressure pulsates within the range of 0.5–0.6 kg/cm$^2$G.

Therefore, compared with the conventional compressor, the pressure pulsations of the inlet fluid and the outlet fluid of the compressor of the present invention is much lower.

EXPERIMENT 2

The change of the volumetric efficiency relative to the change of the engine speed of each of the same conventional compressor and the same compressor of the present invention as those which were employed in Experiment 1 was measured.

The inlet pressure was 2 kg/cm$^2$G and the outlet pressure was 15 kg/cm$^2$G.

Figure 6:
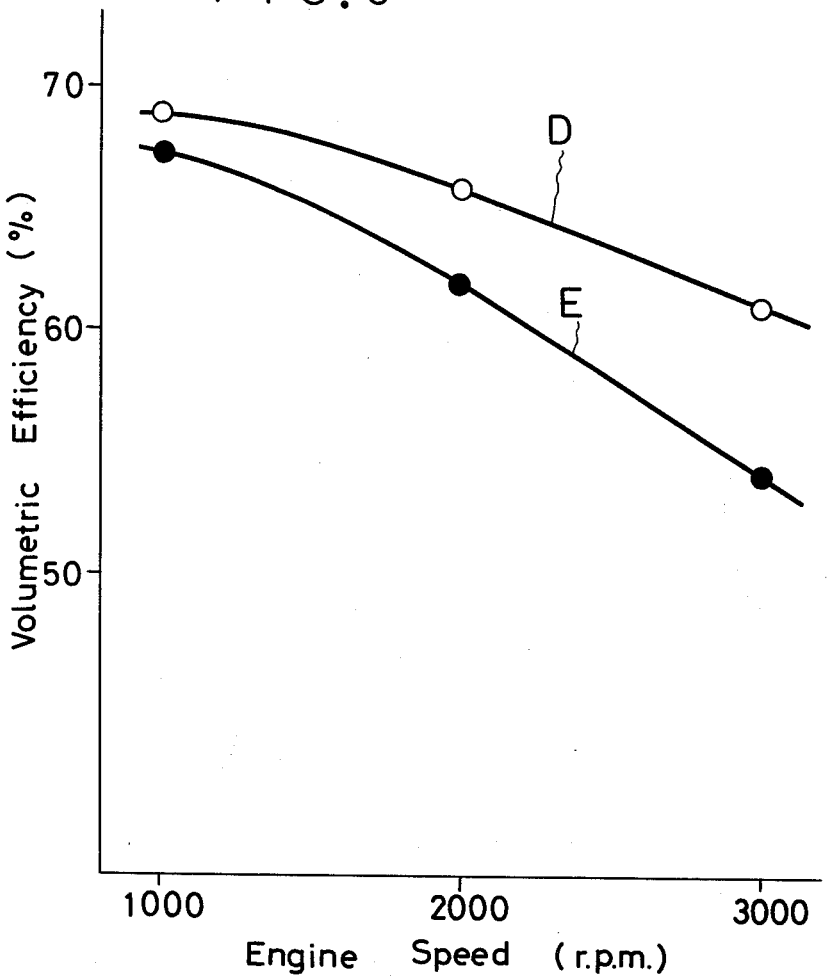
FIG. 6 is a graph showing the change of the volumetric efficiency of the conventional compressor and that of the compressor of the present invention.

The experimental result is shown in FIG. 6. In the drawing, line D shows the change of the volumetric efficiency relative to the engine speed of the compressor of the present invention, respectively, and line E shows that of the conventional compressor, respectively.

As is apparent from the drawing, according to the compressor of the present invention, the volumetric efficiency is larger than that of the conventional compressor over any engine speed and is not largely lowered even if the engine speed is increased, compared with the conventional compressor.

Having now fully described the invention, it will be apparent to one of ordinary skill in the art that many changes and modifications can be made thereto without departing from the spirit or scope of the invention as set forth herein.

What is claimed is:

1. A swash plate type compressor comprising:

a pair of horizontal axially aligned cylinder blocks forming a combined block;

a swash plate chamber perforated in the axially central portion of said combined block;

a plurality of cylinder bores perforated in said combined block in the axial direction thereof;

a plurality of pistons, each of said plurality of pistons being slidably inserted within each of said plurality of cylinder bores;

a drive shaft disposed through said swash plate chamber and rotatably supported by said combined block in the axial portion thereof;

a swash plate disposed within said swash plate chamber and fixed to said drive shaft so as to be rotated therewith, said swash plate being connected with said pistons through bearing balls and shoes so as to reciprocate said pistons within said cylinder bores due to the rotation of said swash plate;

a pair of cylinder housing fixed to the ends of said combined block, one of said pair of cylinder housings having a shaft seal chamber in the axial portion thereof for accommodating a shaft seal member which is disposed around said drive shaft;

at least one suction chamber and at least one exhaust chamber perforated in each of said pair of cylinder housings, said suction chamber and said exhaust chamber being communicated with each of said cylinder bores through valve means;

at least one suction passage perforated in said combined block in the axial direction thereof between said cylinder bores adjacent to each other so as to be communicated with said swash plate chamber in the middle thereof;

two inlet ports for introducing a fluid from an outer pipeline and at least one outlet port for discharging a compressed fluid into an outer pipeline;

said two inlet ports being provided in said combined block so as to be aligned with each other in a longitudinal direction thereof; and said two inlet ports opening into said swash plate chamber directly so that each of the wall surfaces defining said two inlet ports in the side of the center of said swash plate chamber in said longitudinal section is nearly in alignment with an inner edge portion of said swash plate when said swash plate is inclined to the utmost limit thereof in a front side or a rear side of said combined block in said longitudinal section, and so that each of the wall surfaces which define said two inlet ports in the side of said cylinder housings in said longitudinal section, is deviated from an outer edge portion of said swash plate by a predetermined distance outside of said outer edge portion of said swash plate when said swash plate is inclined to the utmost limit thereof in a front side or a rear side of said combined block in said longitudinal section.

* * * * *